United States Patent [19]

Lasier et al.

[11] Patent Number: 4,916,267

[45] Date of Patent: Apr. 10, 1990

[54] DOOR CLOSER POSITION MONITOR

[75] Inventors: Thomas R. Lasier, Princeton; William L. Downey, Peru, both of Ill.

[73] Assignee: Schlage Lock Company, San Francisco, Calif.

[21] Appl. No.: 289,317

[22] Filed: Dec. 23, 1988

[51] Int. Cl.[4] ..... G08B 13/08; H01H 3/16

[52] U.S. Cl. ..... 200/61.62; 49/14

[58] Field of Search ..... 200/61.62, 61.64, 61.7; 49/13, 14, 15, 274, 386

[56] References Cited

U.S. PATENT DOCUMENTS 4,016,381 4/1977 Rodseth ..... 200/61.62

4,562,664 1/1986 Kambic ..... 200/61.62 X

*Primary Examiner*—J. R. Scott

*Attorney, Agent, or Firm*—Walter C. Vliet

[57] ABSTRACT

A door closer mechanism that controls the opening and closing swing of a door, in conjunction with an integral switch that electrically signals when the security of the closed door has been violated by partially opening the door. The device is especially important and useful in high security installations including detention facilities and features a secure field adjustment feature to accommodate door positioning and rattle.

17 Claims, 3 Drawing Sheets

DOOR CLOSER POSITION MONITOR

BACKGROUND OF THE INVENTION

Door closers containing a position switch are known in the prior art. For example, see Rodseth, U.S. Pat. No. 4,016,381 and Zunkel, U.S. Pat. No. 4,721,946. In addition, the prior art discloses certain door position monitoring apparatus such as for example, Kambic, U.S. Pat. No. 4,334,388. A need exists, however, for a door closer having an internal position indicating switch assembly which is readily adjustable upon installation in the field, yet is tamper resistant to further unauthorized adjustment or tampering.

SUMMARY OF THE INVENTION

The present invention discloses a door closer having a reliable field adjustable position indicating switch assembly which is readily manufactured, easily installed and secured from subsequent unauthorized adjustment or tampering. These and other objects are contained in a force producing means for accomplishing door positioning coupled to a door by linkage means, a position sensing means coacting with the linkage means to monitor door position, the position sensing means further comprising means for reporting a particular door position, the means for reporting a particular door position being field adjustable on installation, tamper resistant in the insecure or open position of the door, and inaccessible in the secure or closed position of the door.

DESCRIPTION OF THE PREFERRED EMBODIMENT

Figure 2:
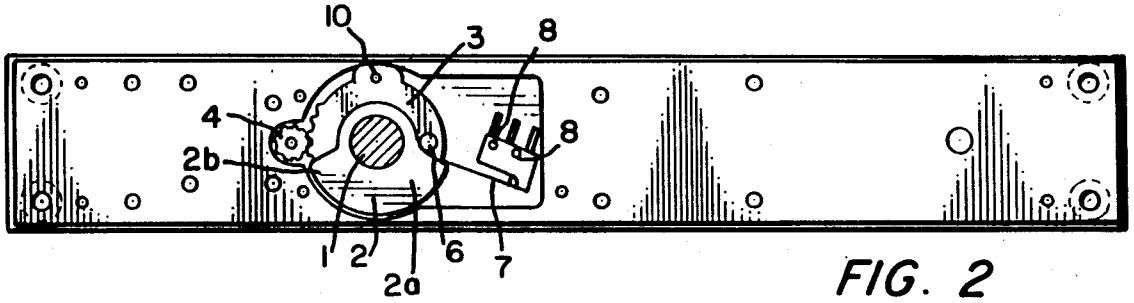
FIG. 2 is a plan view of the door closer showing orientation of the major components according to the present invention.

As installed, the door closer/switch assembly is completely concealed in the head frame of a doorway, or it can be surface mounted under a tamper resistant enclosure.

A conventional spring return hydraulic retarded door closer 19 is shown attached to mounting plate 9. The door closer has its output to a rotary drive shaft 1. The security switch, according to the present invention, is operatively associated with the rotary output shaft as will now be described.

An arm 13, attached to the drive shaft 1 of the closer 19, connects the closer mechanism to the door (not shown) utilizing a roller 16 traversing a track 15 that is mortised into an opening within the top of the door. The arm 13 recesses parallel to and over the top of the door as the door closes. Therefore, when the door is in the closed (secure) position, none of the mechanism is visible or accessible for vandalism. The arm is attached to the drive shaft 1 with a special tamper resistant screw 14. The track is similarly fastened in the door with tamper resistant screws (not shown). The roller assembly 16 is semi-permanently threaded into one end of the arm 13 at the factory utilizing a drive socket at the bottom, or blind, end of the roller assembly that is never approachable for disassembly while the door and closer mechanism are mounted in the door frame.

The location of the closer in the head frame, the track in the door, and the length and shape of the connecting arm permit the door to be opened a full 180 degrees if the wall construction and pivoting members allow.

The door closer and its control of a door panel is a standard product and as such is a well-known entity in the art that needs no further explanation.

The adjustable switch/signal generating feature attached to the door closer is what is unique and is an improvement over known apparatus.

Simply stated, a clutchable trigger 2 mounted on and rotating with the drive shaft 1 impinges a movable arm of an electrical switch 7 at an adjustable predetermined point of door movement. The switch can be optionally wired in the well known manner as normally open or normally closed and can be single or double pole. The reversal of the contacts sends a signal, to whatever alarm system is employed, that the door is not at the closed (secure) position. Thus a monitor at a remote location will be alerted that the door is being opened, or conversely that it has not fully closed following an authorized opening.

A unique adjustment mechanism permits only authorized personnel to vary the point, at which the switch reports during the movement of the door.

A further preferable feature provides a "non-reporting null zone" during approximately the first 3/16" of door movement away from the frame stop. This is desirable because the door lock bolts often fit loosely in their strike plates, allowing the doors to be harmlessly moved the distance allowed by this looseness even as they remain securely locked. If the switch was not tolerant of this slight movement, it would erroneously signal an open door during this null, or float movement.

Figure 1:
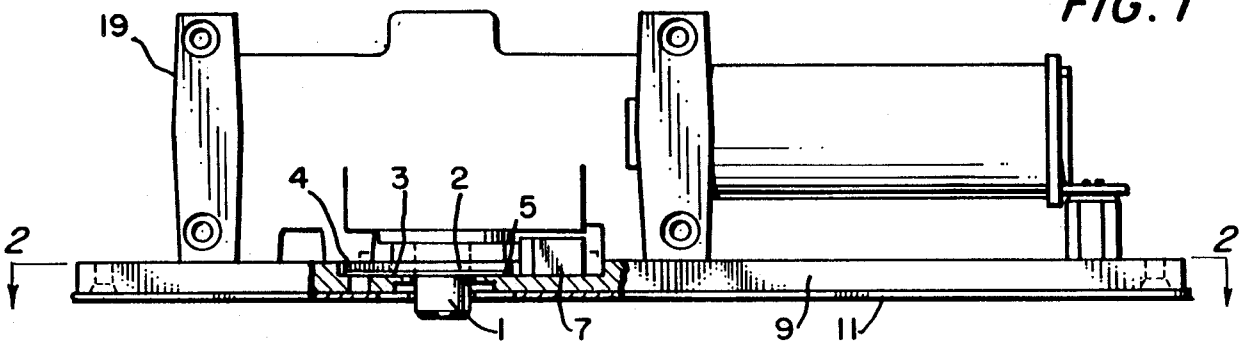
FIG. 1 shows a side view of a door closer having the door position indicator and adjustment feature of the present invention.
Figure 3:
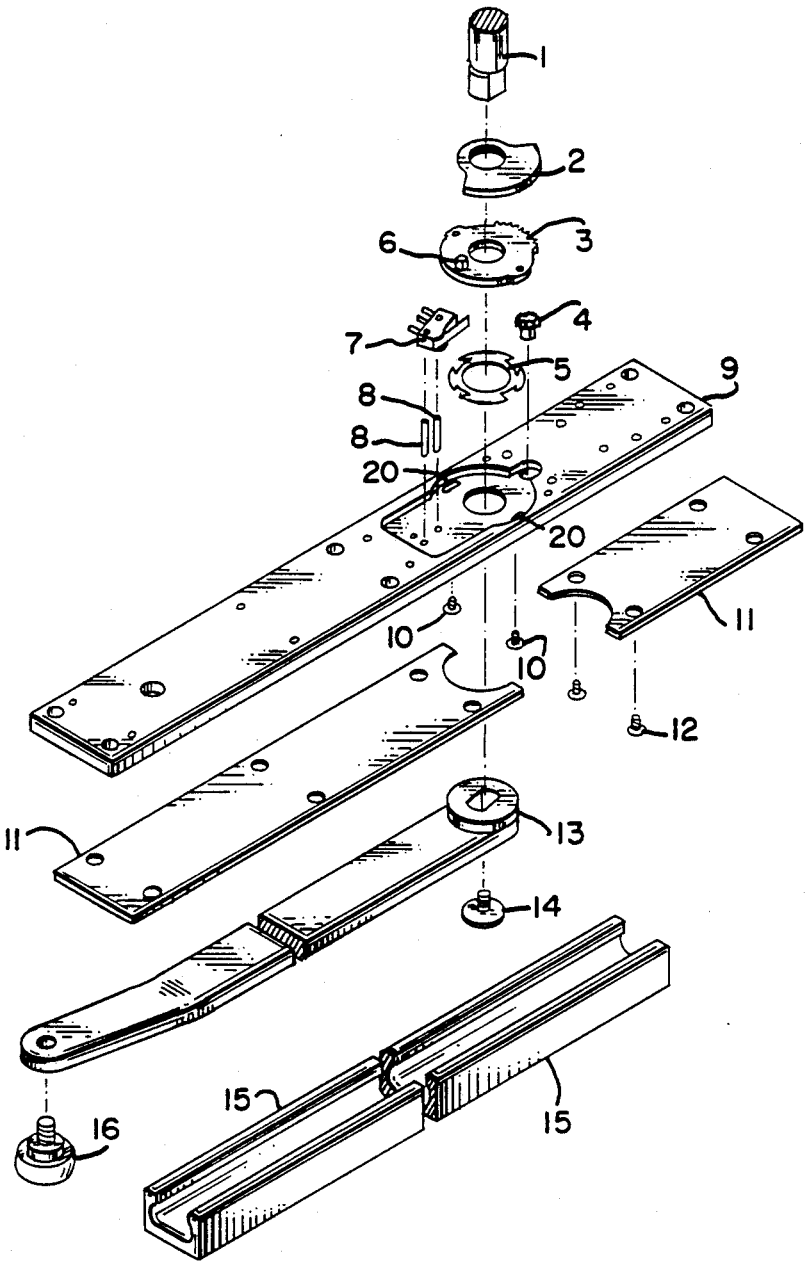
FIG. 3 shows an exploded view of the door control assembly according to the present invention.
Figure 4:
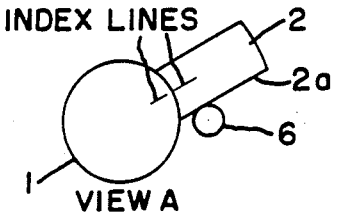
FIGS. 4 through 8 display a simplified sketch of the indexing and adjustment mechanism of the present invention as an aid to describing the adjustment feature of the present invention.
Figure 5:
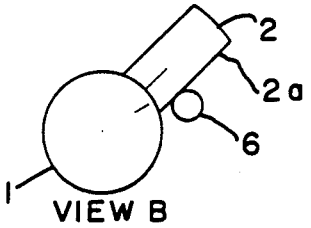

Referring to FIGS. 1 and 2 of the drawings: The Drive Shaft 1, penetrates the Door Closer 19 (best seen in FIG. 2), where its gear portion engages a piston which is biased by a spring to effect a door closing action via Arm 13, which is keyed to Shaft 1, by driving flats. Trigger 2, is clutchable on Shaft 1, and will turn with the shaft below a certain torque, but will slip and rotate on the shaft when the torque exceeds a certain limit. Adjustment Plate 3, with Stop Pin 6, has a gear segment that meshes with Adjustment Pinion 4, which has a keyed drive socket that is available only when Security Plate 11 is detached by removing Tamper Resistant Screws 12. Referring now to FIG. 3, Flat Fingered Spring 5, is interposed between Adjustment Plate 3, and Mounting Plate 9, to stabilize the rotary movement of Adjusting Plate 3, when Locking Screws 10 which project through mounting plate 9 in oval slots 20 and are threadingly engaged with the adjusting plate 3 and locks its position are loosened. Stop Pin 6, limits rotation 2, and serves as part of the adjustment mechanism that determines the point at which Trigger 2, trips Switch 7, which is located and retained by Pins 8.

Arm 13 is keyed to Shaft 1, and retained by Tamper Resistant Screw 14. Track 15, guides Roller/Stud Assembly 16, attached at end of Arm 13, the combination of which transmits the control action of the door closer to the door.

DESCRIPTION OF OPERATION

It will be understood from the foregoing description that the principal need for this invention is in high security areas and, therefore, all parts of the device are inaccessible when the door is closed. In a further attempt to make the product vandal resistant, the Roller Assembly 16, cannot be removed from the Arm 13, as long as all associated parts remain in their proper positions; no regulation or resetting can be done unless the protective Security Plates 11, are disassembled by removing ten Tamper Resistant Screws 12.

As the door is opened, Arm 13, keyed to Shaft 1, turns Trigger 2, counterclockwise away from Switch 7, as seen in the plan view When the latch edge of the door has moved at least 3/16 inch away from the frame stop, the Trigger 2, has revolved enough to allow contacts in Switch 7 to reverse, thereby opening or closing the circuit and sending a signal to a remote alarm panel, audible alarm, or other suitable receptor. Switch 7, may optionally be a double pole-double throw unit that is electrically connected to a reporting switch activated by the lock bolt to confirm that the door is both closed and locked, or unlocked and open.

It is anticipated that there may be situations where the 3/16" door open alarm point may be inappropriate and a field adjustment to change the alarm point to a position where a signal will be sent when the door is opened further, but still within the pocket (or reveal) of the door frame, has been incorporated in this invention. FIGS. 4 through 8 shows simplified diagrams of components: 1 (Shaft), 2 (Trigger) and 6 (Stop Pin attached to Adjustment Plate 3). It will be assumed for illustrative purpose that the mechanism, as shown, is adjusted to report the position of the door when it is about one inch from being fully closed and against the stop.

Index lines (depicted in FIGS. 4 through 8) have been included to clarify the explanation. As a security panel (door or similar leaf) is swung open, Shaft 1, carrying clutchable Trigger 2, will revolve (urged by Arm 13 as explained earlier) and will reverse direction during the closing swing. It always returns to the same position as indicated by the index mark in FIGS. 4, 5, 6, and 8. Trigger 2, however, because it is clutchable need not always return to the same position if an adjustment of the point of signal generation is required. It is this establishment of a different radial relationship between Shaft 1 and Trigger 2 that provides the unique ability to vary the door position status report. As previously described, Adjustment Pinion 4 (accessible only to authorized personnel) rotatably meshes with Adjustment Plate 3 carrying Stop Pin 6, which abuts Surface 2*a* of Trigger 2. Rotating Stop Pin 6 in a counterclockwise direction moves Trigger 2 to the position shown (and exaggerated by the index lines) in FIG. 5.

This repositioning of Trigger 2, on Shaft 1, results in Trigger 2 striking Switch 7 later in the door closing swing as the door moves into its frame approaching its stop.

Figure 6:
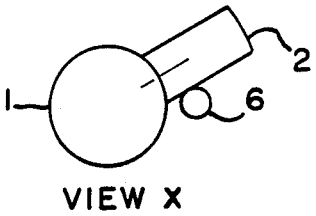
Figure 7:
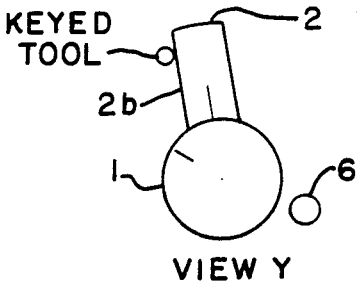

Conversely, adjustment to send a report signal earlier during the door closing swing is possible. FIG. 6 shows Shaft 1, Trigger 2, and Stop Pin 6, in what will be assumed to be the report position when the door is about one inch from fully closed. The authorized adjustor removes the Security Plate 11, exposing Adjustment Pinion 4. Locking screws 10 are then backed of slightly to release adjustment plate 3 for rotation to the limits provided by the locking screws in the oval slots 20. Using a keyed tool, Adjustment Pinion 4, is rotated counterclockwise which will turn Adjustment Plate 3, with on-board Stop Pin 6, in a clockwise direction as shown in FIG. 7. The keyed tool is now inserted into a special access hole in Mounting Plate 9, and the door is opened approximately 45 degrees. As shown in FIG. 7, Surface 2*b* of Trigger 2, strikes said stationary tool, interrupting the radial rotation of clutchable Trigger 2 as Shaft 1 continues its rotation in response to the opening action of the door, thereby affecting a change in the radial orientation between Trigger 2, and Shaft 1, as defined exaggeratedly by the index lines in FIG. 7.

Figure 8:
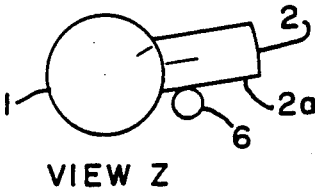

Having moved Trigger 2, on Shaft 1, the keyed tool is withdrawn, the locking screws 10 retightened, and the door is released allowing it to close. Surface 2*a* of substantially advanced Trigger 2 strikes relocated Stop Pin 6, as can be seen in FIG. 8 thereby achieving the desired adjustment of Trigger 2. The "advanced" trigger point (compare index lines in FIGS. 6 and 8) will now initiate a report signal at a point earlier (or when the door is farther from the frame stop) in the door opening and closing swing.

The point of signal response, whether advanced or retarded will remain "as set" until it is purposefully readjusted by the authorized personnel.

A further refinement of this invention is a built-in restriction to prevent accidental adjustment of point of signal response when the door is out of the door frame recess. Adjustment Plate 3 is restricted from rotating beyond a point where Stop Pin 6 will relocate Trigger 2 to trip Switch 7 when the stop face of the door is more than $1\frac{3}{4}$ inches from the frame stop. This is accomplished by Locking Screws 10 being retained in Oval Slot 20. This length of the vane slot limiting the rotation of Adjustment Plate 3.

This invention disclosed a door closer mechanism that controls the opening and closing swing of a door in conjunction with an integral switch that electrically signals when the security of the closed door has been violated by partially opening the door.

Having described our invention in terms of a preferred embodiment we do not wish to be limited in the scope of the invention except as claimed.

We claim:

1. A Door Position Control and Monitoring Apparatus comprising: a force producing means for accomplishing door positioning coupled to a door by linkage means; a position sensing means coacting with said linkage means to monitor door position; said position sensing means further comprising means for reporting a particular door position; said means for reporting a particular door position having means for field adjustment on installation, said means being tamper resistant in the insecure or open position of the door and inaccessible in the secure or closed position of the door; said force producing means for accomplishing door positioning is a door closer; said linkage means further comprising a rotating output shaft exiting said door closer and having a linkage arm attached thereto for rotation with said output shaft, said linkage arm engaging a track means mounted substantially within and concealed in one edge of said door.

2. A Door Position Control and Monitoring Apparatus according to claim 1 wherein: said force producing means for accomplishing door positioning is a spring actuated hydraulic retarded door closer.

3. A Door Position Control and Monitoring Apparatus according to claim 1 wherein: said linkage arm engages said track means with a roller trapped within said track means on assembly and concealed in said track means.

4. A door Position Control and Monitoring Apparatus according to claim 3 wherein: said roller cannot be disassembled from said linkage arm while it is trapped in said track means.

5. A Door Position Control and Monitoring Apparatus according to claim 3 wherein: said position sensing means comprises a clutchable trigger member mounted on said output shaft for rotation therewith, said trigger member contacting a switch at a prescribed point in rotation for establishing a position signal.

6. A Door Position Control and Monitoring Apparatus according to claim 5 wherein: adjustment means are provided to establish the position of said clutchable trigger member on said rotating shaft.

7. A Door Position Control and Monitoring Apparatus according to claim 6 wherein: said adjustment means comprises a plate member mounted for rotation in close parallel relationship to said clutchable trigger member; said adjustment means plate being further provided with a stop means for coacting with said clutchable trigger member to effect positioning of said clutchable trigger member about said output shaft.

8. A Door Position Control and Monitoring Apparatus according to claim 7 wherein: said adjustment plate means is further provided with means for positioning said adjustment plate means and means for securing, the position of said adjustment plate means.

9. A Door Position Control and Monitoring Apparatus according to claim 8 wherein: said adjustment plate means is provided with a gear segment on its periphery which coacts with a gear drive means to effect positioning of said adjustment plate means and further said adjustment plate means is secured in a selected position by locking means.

10. A Door Position Control and Monitoring Apparatus according to claim 9 wherein: said locking means further comprise lock screws.

11. A Door Position Control and Monitoring Apparatus according to claim 9 wherein: said adjustment plate means is further stabilized during adjustment by spring plate means.

12. A Door Position Control and Monitoring Apparatus according to claim 9 wherein: said positioning of said adjustment plate means is limited in both rotational directions.

13. A Door Position Control and Monitoring Apparatus according to claim 12 wherein: the limiting of said adjustment plate is achieved by restrictive slots enveloping said lock screws.

14. A Door Position Control and Monitoring Apparatus according to claim 5 wherein: said clutchable trigger member is mounted on said output shaft with a slight interference fit to accomplish friction drive.

15. A Door Position Control and Monitoring Apparatus according to claim 5 wherein: said clutchable trigger member comprises a plate cam mounted for releasable rotation on said output shaft and having a first striking surface for intercepting a locating pin in one direction and a second striking surface for interception of a locating pin in the reverse direction.

16. A Door Position Control and Monitoring Apparatus according to claim 15 wherein: said plate cam further comprises a substantially circular plate having a major diameter and a reduced minor diameter interconnected by two sloped surfaces forming said first and said second striking surfaces.

17. A Door Position Control and Monitoring Apparatus according to claim 1, wherein: said linkage arm is inaccessibly concealed above the door when the door is closed.

* * * * *